US011098544B2

(12) United States Patent
Andersen

(10) Patent No.: US 11,098,544 B2
(45) Date of Patent: Aug. 24, 2021

(54) DOWNHOLE TOOL WITH LONG PROJECTING EXTENSION

(71) Applicant: WELLTEC A/S, Allerød (DK)

(72) Inventor: Tomas Sune Andersen, Allerød (DK)

(73) Assignee: Welltec A/S, Allerød (DK)

( * ) Notice: Subject to any disclaimer, the term of this patent is extended or adjusted under 35 U.S.C. 154(b) by 13 days.

(21) Appl. No.: 16/704,343

(22) Filed: Dec. 5, 2019

(65) Prior Publication Data

US 2020/0181997 A1 Jun. 11, 2020

(30) Foreign Application Priority Data

Dec. 6, 2018 (EP) ..... 18210801

(51) Int. Cl.

| | |
|---|---|
| ***E21B 23/04*** | (2006.01) |
| ***E21B 23/01*** | (2006.01) |
| ***E21B 17/10*** | (2006.01) |
| ***E21B 23/03*** | (2006.01) |

(Continued)

(52) U.S. Cl.

CPC .... *E21B 23/04115* (2020.05); *E21B 17/1014* (2013.01); *E21B 23/01* (2013.01); *E21B 23/03* (2013.01); *E21B 23/0412* (2020.05); *E21B 23/0419* (2020.05); *E21B 23/08* (2013.01); *E21B 23/14* (2013.01)

(58) Field of Classification Search

CPC ..... E21B 23/08; E21B 23/01; E21B 23/03; E21B 23/14; E21B 23/04; E21B 17/1014; E21B 49/10; E21B 23/0411; E21B 23/04115; E21B 23/0412; E21B 23/0416; E21B 23/0418; E21B 23/0422; E21B 23/0419

See application file for complete search history.

(56) References Cited

U.S. PATENT DOCUMENTS 2,743,781 A * 5/1956 Lane ..... E21B 23/04 166/212

3,512,592 A 5/1970 Kellner (Continued)

FOREIGN PATENT DOCUMENTS

WO 2008/128542 10/2008

OTHER PUBLICATIONS

Extended Search Report for EP18210801.9, dated Jun. 4, 2019, 5 pages.

*Primary Examiner* — Nicole Coy

(74) *Attorney, Agent, or Firm* — Nixon & Vanderhye P.C.

(57) ABSTRACT

A downhole tool for projecting a projectable element downhole includes a tool body having a radial bore, a projectable element forming a piston in the radial bore, the projectable element having first and second element parts. In the retracted position the projectable element and the second bore part define an annular cavity, a hollow base part having an open end and a closed end, the open end extending into the open first end of the projectable element forming a chamber. The open end of the hollow base part has at least one spring element arranged in the chamber and connected to the closed first end of the projectable element and to the closed end of the hollow base part for retraction of the projectable element, and a pump configured to pump fluid into the chamber via a fluid channel to project the projectable element.

15 Claims, 5 Drawing Sheets

(51) Int. Cl.
*E21B 23/08* (2006.01)
*E21B 23/14* (2006.01)

(56) References Cited

U.S. PATENT DOCUMENTS

| | | | | |
|---|---|---|---|---|
| 3,859,851 | A * | 1/1975 | Urbanosky | E21B 49/10 73/152.24 |
| 5,531,280 | A * | 7/1996 | Steinkamp | E21B 23/04 175/230 |
| 7,878,272 | B2 * | 2/2011 | Eppink | E21B 17/1014 175/325.1 |
| 8,230,914 | B2 * | 7/2012 | Hallundbaek | E21B 23/01 166/212 |
| 9,175,518 | B2 * | 11/2015 | Kotsonis | E21B 23/01 |
| 2014/0374100 | A1 | 12/2014 | Hallundbaek et al. | |
| 2015/0259997 | A1 * | 9/2015 | Millet | E21B 17/1078 166/383 |
| 2016/0130904 | A1 | 5/2016 | Andersen | |
| 2017/0226837 | A1 * | 8/2017 | Kumar | E21B 33/1295 |
| 2017/0350193 | A1 * | 12/2017 | Andersen | E21B 4/02 |
| 2019/0055792 | A1 * | 2/2019 | Sui | E21B 17/1014 |

* cited by examiner

DOWNHOLE TOOL WITH LONG PROJECTING EXTENSION

CROSS REFERENCE TO RELATED APPLICATION

This application claims priority to EP Patent Application No. 18210801.9 filed 6 Dec. 2018, the entire contents of which is hereby incorporated by reference.

BACKGROUND

The present invention relates to a downhole tool for projecting a projectable element downhole in order for the tool to perform an operation in a well. The invention also relates to a downhole tool string comprising the downhole tool and a driving unit for propelling the tool string forward in the well.

BRIEF SUMMARY

In known tools, e.g. an anchor tool known from WO2008/128542, where the projectable anchor parts are projected by hydraulics and retracted by a spring, the projection of the anchor parts is restricted due to the size of the spring. When the tool is submerged far into a well, the pressure in the well increases and the tool therefore often needs to be pressure compensated so that the housing of the tool does not collapse. The pressure within the tool is thus at surface increase putting a pressure on the anchor parts, and the spring thus needs to be extra strong to be able to hold the anchor parts within the tool while submerging from the surface and into the well. ACcordingly, there is a need for another solution in order to provide an anchor tool with a higher radial projectable reach.

It is an object of the present invention to wholly or partly overcome the above disadvantages and drawbacks of the prior art. More specifically, it is an object to provide an improved downhole tool which makes it possible to project parts longer radially outwards than in known tools.

The above objects, together with numerous other objects, advantages and features, which will become evident from the below description, are accomplished by a solution in accordance with the present invention by a downhole tool for projecting a projectable element downhole in order for the tool to perform an operation in a well, comprising:

- a tool body having a tool outer diameter and a longitudinal extension,
- a radial bore extending in a radial direction perpendicular to the longitudinal extension, the radial bore having a first bore part having a first inner diameter and a second bore part having a second inner diameter being larger than the first inner diameter,
- a projectable element arranged and forming a piston in the radial bore, the projectable element having an open first end and a closed second end, the projectable element having a retracted position and a projected position where the second end is projected from the first bore part, the projectable element comprising at the second end a first element part having a first outer diameter corresponding to the first inner diameter and a second element part having a second outer diameter corresponding to the second inner diameter, in the retracted position the projectable element and the second bore part define an annular cavity closed by the second element part,

- a hollow base part having an open end and a closed end, the open end extending into the open first end of the projectable element forming a chamber therebetween, the open end of the hollow base part having an outer diameter which corresponds to an inner diameter of the projectable element,
- at least one spring element arranged in the chamber and connected to the closed first end of the projectable element and to the closed end of the hollow base part for retraction of the projectable element,
- a pump configured to pump fluid into the chamber via a fluid channel to move the projectable element into the projected position, wherein the annular cavity is filled with fluid which leaves the annular cavity as the projectable element changes to the projected position minimising the annular cavity.

Also, the downhole tool may be an anchor tool configured to anchor the tool in a certain position downhole, the projectable element being an anchoring projectable element.

Moreover, the annular cavity may have a first cavity extension in the longitudinal extension being at least 20% of the tool diameter.

Furthermore, the annular cavity may have a second cavity extension perpendicular to the longitudinal extension which is less than the first cavity extension.

In addition, the downhole tool may comprise a first sealing element configured to seal between the first element part and the first bore part, and the second element part may comprise a second sealing element configured to seal between the second element part and the second bore part and thereby sealing off the annular cavity.

Further, a third sealing element may be arranged on an outer face at the open end of the hollow base part configured to seal between the hollow base part and the projectable element and thereby sealing off the chamber.

Additionally, the spring may be a retraction spring.

Moreover, the closed second end may have an outer face.

Furthermore, the outer face of the closed second part may have a key profile matching a groove in a sliding sleeve for pulling in the sleeve.

Also, a punching bit may be arranged in the outer face of the closed second part.

In addition, the outer face of the closed second part may have friction-enhancing means, e.g. small spikes, small grooves or similar.

Further, the first bore part may be provided by a first annular flange in the tool body, and the second element part may be shaped as a second annular flange, the annular cavity being defined between the first annular flange and the second annular flange.

Additionally, the chamber may be fluidly connected to the annular cavity via the pump or a hydraulic section.

Moreover, the pump may suck fluid from the annular cavity and pump it into the chamber for projecting the projectable element.

Furthermore, the annular cavity may be filled with fluid from the chamber through the hydraulic section.

Also, the pump may pump fluid into the annular cavity from the chamber for retracting the projectable element.

In addition, the hydraulic section may comprise an accumulator.

Further, the tool may comprise a motor for driving the pump.

Additionally, the tool may comprise a wireline, a cable such as an optical cable, or e-line.

Also, the motor may be powered through the wireline, a cable such as an optical cable, or e-line via an electronic section.

Moreover, the projectable element and the hollow base part may overlap in the retracted position of the projectable element, the overlap being longer than 50% of the tool outer diameter.

Furthermore, the second element part may project from the first element part perpendicular to the radial direction forming a projected area, and fluid in the chamber may then press on a chamber area of an internal face of the first element part of the projectable element in order to project the projectable element, the projected area and the chamber area being substantially of the same size.

In addition, the downhole tool may further comprise a compensator configured to provide a small overpressure with the tool.

Further, the tool may comprise several projectable elements arranged so a first projectable element projects in a first direction and the adjacent second projectable element projects in a second direction opposite of the first direction.

Additionally, the downhole tool according to the present invention may further comprise a third projectable element projecting in a third direction perpendicular to the first direction, and an adjacent fourth projectable element projecting in a fourth direction opposite of the third direction.

Moreover, the hollow base part may be a separate part fastened to the body and forming part of an outer tool face of the tool.

Furthermore, part of the fluid channel may extend partly into the closed end of the hollow base part for guiding fluid into the chamber.

Also, the closed end of the hollow base part may form part of the outer tool face.

In addition, the second element part may divide the second bore part into the annular cavity and a second cavity, which is in fluid communication with an opening in the tool for providing fluid communication between the well and the second cavity.

Further, part of the fluid channel may extend parallelly to the longitudinal extension of the tool past the projectable element.

Moreover, the chamber may have a longitudinal extension along the longitudinal extension of the tool.

Additionally, the tool may have at least two springs arranged in the chamber matching the longitudinal extension of the chamber.

Furthermore, the second bore may have an extension of at least 50% of the tool diameter.

Finally, the present invention also relates to a downhole tool string comprising the downhole tool and a driving unit for propelling the tool string forward in the well.

BRIEF DESCRIPTION OF THE DRAWINGS

The invention and its many advantages will be described in more detail below with reference to the accompanying schematic drawings, which for the purpose of illustration show some non-limiting embodiments and in which.

DETAILED DESCRIPTION

All the figures are highly schematic and not necessarily to scale, and they show only those parts which are necessary in order to elucidate the invention, other parts being omitted or merely suggested.

Figure 1:
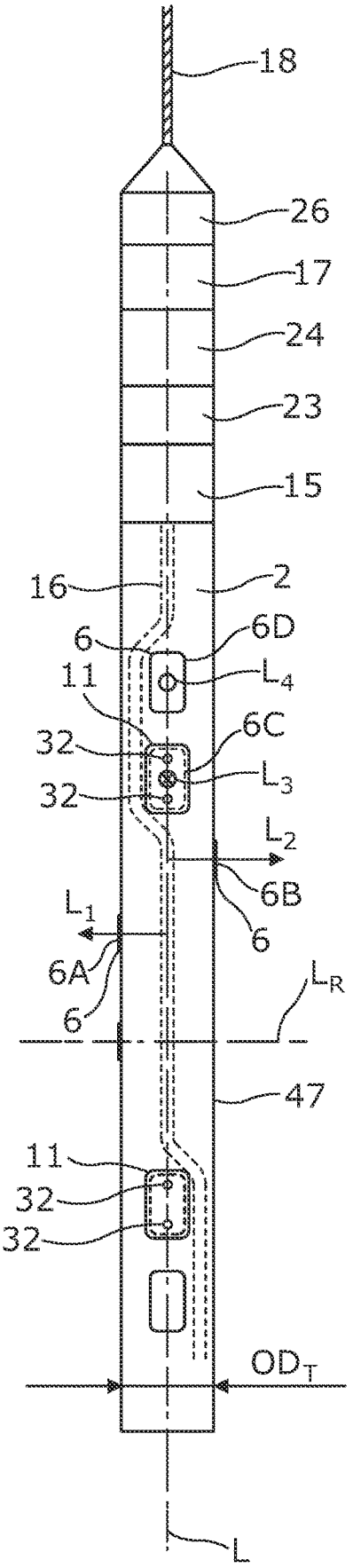
FIG. 1 shows a downhole tool having several projectable elements.

FIG. 1 shows a downhole tool 1 for projecting a plurality of projectable elements in a well downhole in order for the tool to perform an operation in the well. The operation may be setting or pulling a plug downhole, and the downhole tool thus needs to anchor the tool string with the setting or pulling tool by projecting the projectable elements. The downhole tool comprises a tool body 2 having a tool outer diameter $OD_T$ and a longitudinal extension L.

Figure 2:
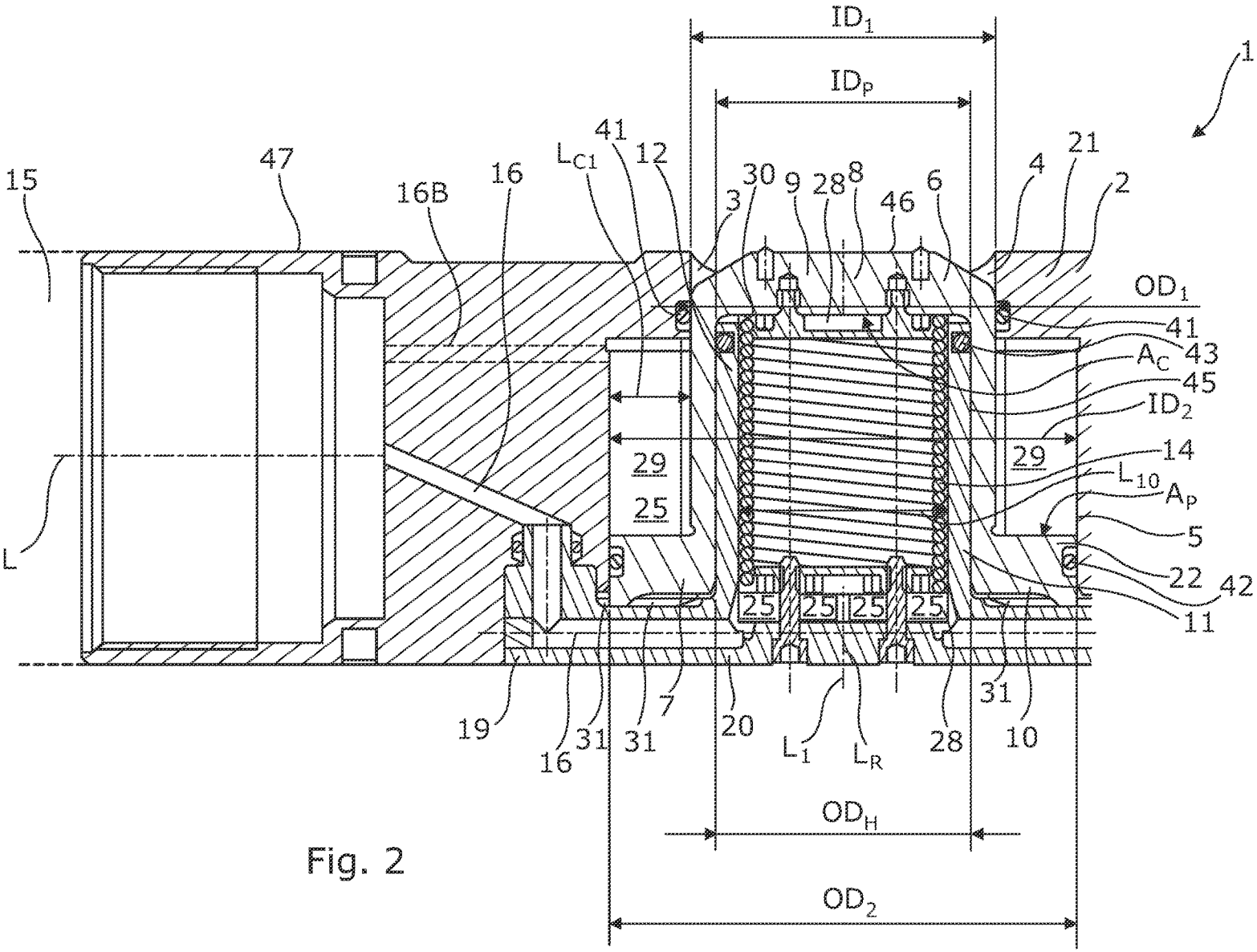
FIG. 2 shows a partly cross-sectional view of a downhole tool having a projectable element.

In FIG. 2, the downhole tool further comprises a radial bore 3 extending in a radial direction $L_R$ perpendicular to the longitudinal extension. The radial bore is not necessarily a through-bore but has a first bore part 4 having a first inner diameter $ID_1$ and a second bore part 5 having a second inner diameter $ID_2$ being larger than the first inner diameter. The downhole tool 1 further comprises a projectable element 6 arranged in the radial bore 3 and forming a piston in the radial bore. The projectable element 6 has an open first end 7 and a closed second end 8. The projectable element has a retracted position (shown in FIG. 1) and a projected position where the second end 8 is projected from the first bore part 4. The projectable element 6 comprises at the second end 8 a first element part 9 having a first outer diameter $OD_1$ corresponding to the first inner diameter $ID_1$. The projectable element 6 comprises at the first end 7 a second element part 10 having a second outer diameter $OD_2$ corresponding to the second inner diameter. In the retracted position, the projectable element and the second bore part define an annular cavity 29 closed by the second element part. The downhole tool further comprises a hollow base part 11 having an open end 12 and a closed end 20. The open end 12 of the base part 11 extends into the open first end of the projectable element forming a chamber 28 therebetween. The hollow base part has an outer diameter $OD_H$ at the open end 12 which corresponds to an inner diameter $ID_P$ of the projectable element. A spring element 14 is a retraction spring, which is arranged in the chamber and is connected to the closed first end 7 of the projectable element 6 and to the closed end 20 of the hollow base part 11 for retraction of the projectable element 6 when the projectable element has been projected. The downhole tool further comprises a pump 15 configured to pump fluid into the chamber 28 via a fluid channel 16 to move the projectable element to the projected position. The annular cavity 29 is filled with fluid which leaves the annular cavity as the projectable element changes to the projected position minimising the annular cavity.

By having the annular cavity 29 filled with fluid as the chamber 28 is, the tool is pressure compensated, and the annular cavity is pressure equalising the chamber. Furthermore, there is no need for an extra strong spring since the annular cavity 29 pressure equalises the chamber. When there is no longer a need for an extra strong spring, the spring can be made substantially smaller and with larger displacement distance, and such smaller spring does not take up as much space when fully compressed. Due to the larger displacement distance, the projectable element 8 can then project substantially further out in a radial direction away from the outer tool face 47.

Figure 5:
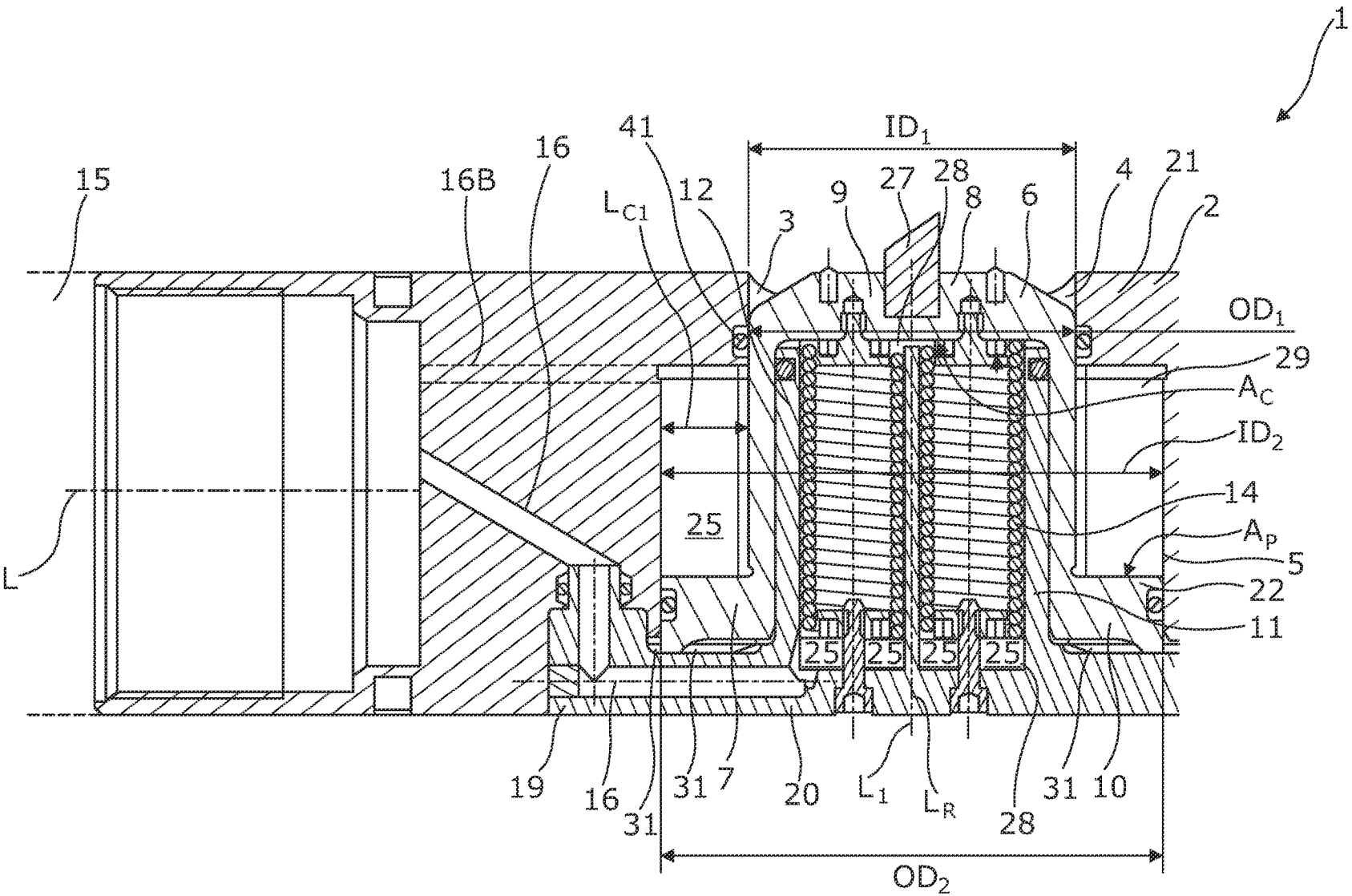
FIG. 5 shows a partly cross-sectional view of another downhole tool having a projectable element.

The downhole tool is an anchor tool in FIG. 1 being configured to anchor the tool in a certain position downhole, and the projectable element is an anchoring projectable element. In another embodiment, the projectable element has a key profile on an outer face 46 matching a groove in a sliding sleeve for pulling in the sleeve or, as shown in FIG. 5, has a punching bit 27 arranged in the outer face of the closed second part of the projectable element. By having the annular cavity outbalancing the chamber, the radial reach of the punching bit or the key can equally be increased.

In FIG. 2, the first bore part 4 is provided by a first annular flange 21 in the tool body, and the first annular flange 21 comprises a groove in which a first sealing element 41 is arranged configured to seal between the first element part and the first bore part. Furthermore, the second element part comprises a second sealing element 42 configured to seal between the second element part and the second bore part and thereby seal off the annular cavity. A third sealing element 43 is arranged on an outer face 45 at the open end of the hollow base part configured to seal between the hollow base part 11 and the projectable element 6 and thereby seal off the chamber 28. The closed second end 8 has an outer face 46 which is configured to be forced against the wall of a well tubular structure of the wall of a borehole. The outer face of the closed second part has friction-enhancing means, e.g. small spikes, small grooves or similar.

In FIG. 2, the annular cavity 29 has a first cavity extension $L_{C1}$ in the longitudinal extension being at least 10% of the tool diameter, preferably at least 20% of the tool diameter, even more preferably at least 40% of the tool diameter. The first cavity extension depends on the strength of the radial projection and whether the pressure is very high in the well.

In FIG. 2, the first bore part 4 is provided by a first annular flange 21 in the tool body, and the second element part 10 is shaped as a second annular flange 22, and the annular cavity 29 is defined between the first annular flange and the second annular flange. The second element part 10 projects from the first element part 9 perpendicular to the radial direction forming a projected area $A_P$, and fluid in the chamber presses on a chamber area $A_C$ of an internal face 30 of the first element part 9 of the projectable element 6 in order to project the projectable element. As can be seen in FIGS. 3A, 3B, 4A and 4B, the projected area $A_P$ and the chamber area $A_C$ are substantially of the same size.

Figure 3A:
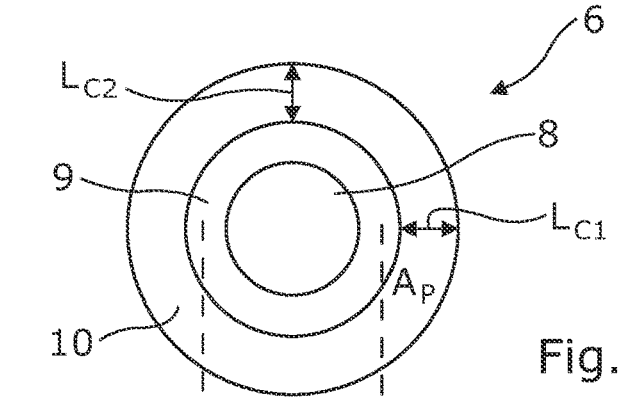
FIG. 3A shows a top view of a projectable element seen from the closed end.
Figure 3B:
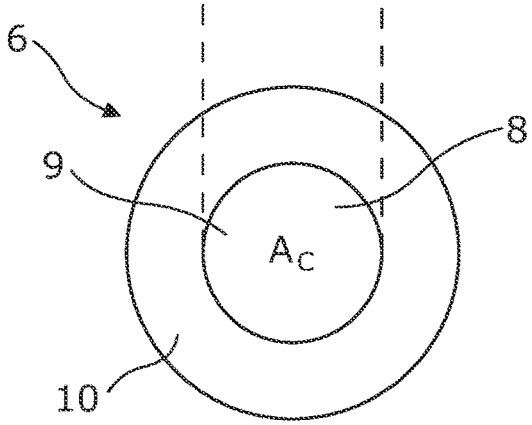
FIG. 3B shows a bottom view of the projectable element of FIG. 3A seen from the open end.
Figure 4A:
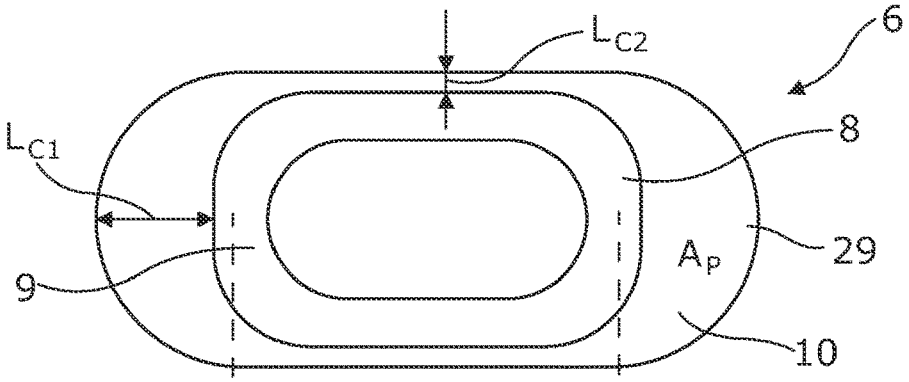
FIG. 4A shows a top view of another projectable element seen from the closed end.
Figure 4B:
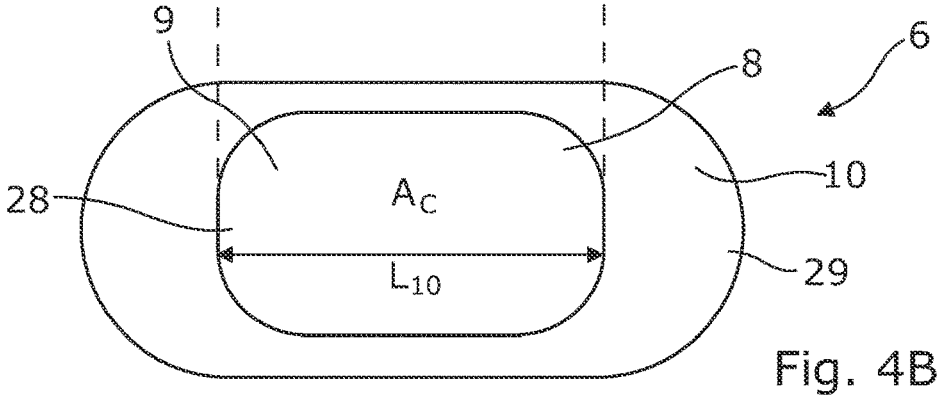
FIG. 4B shows a bottom view of the projectable element of FIG. 4A seen from the open end.

In FIGS. 4A and 4B, the annular cavity 29 has a second cavity extension $L_{C2}$ perpendicular to the longitudinal extension which is less than the first cavity extension. In FIGS. 3A and 3B, the second cavity extension $L_{C2}$ is equal to the first cavity extension $L_{C1}$.

The chamber 28 of FIGS. 2 and 5 is fluidly connected to the annular cavity 29 via the pump 15 and a hydraulic section 23, shown in FIG. 1. The pump sucks fluid from the annular cavity 29 through fluid channel 16B (shown in FIG. 2) and pumps it into the chamber 28 for projecting the projectable element 6. When the projectable element is retracted, the annular cavity 29 is filled with fluid 25 from the chamber through the hydraulic section 23, as shown in FIG. 1. Thus, when retracting the projectable element 6, fluid is sucked from the chamber 28 into the annular cavity 29 by the pump, or the spring 14 retracts the projectable element. The hydraulic section may comprise an accumulator. The tool 1 further comprises a motor 17 for driving the pump. The tool is connected with a wireline 18, a cable such as an optical cable, or e-line. The motor is powered through the wireline, a cable such as an optical cable, or e-line via an electronic section 26. The downhole tool further comprises a compensator 24 configured to provide a small overpressure within the tool. In FIG. 1, the tool comprises several projectable elements 6, 6A, 6B, 6C, 6D. arranged so a first projectable element 6A projects in a first direction $L_1$, and the adjacent second projectable element 6B projects in a second direction $L_2$ opposite of the first direction. A third projectable element 6C projects in a third direction $L_3$ perpendicular to the first direction, and an adjacent fourth projectable element 6D projects in a fourth direction $L_4$ opposite of the third direction.

As shown in FIGS. 2 and 5, the hollow base part is a separate part 19 fastened to the body and forming part of an outer tool face 47 of the tool. The projectable element 6 and the hollow base part 11 overlap in the retracted position of the projectable element, and the overlap is longer than 50% of the tool outer diameter. Part of the fluid channel 16 extends partly in the closed end 20 of the hollow base part 11 for guiding fluid into the chamber 28. The closed end 20 of the hollow base part 11 forms part of the outer tool face 47. The second element part 10 divides the second bore part 5 into the annular cavity and a second cavity 31. The second cavity 31 is in fluid communication with an opening 32 (shown in FIG. 1) in the tool 1 for providing fluid communication between the well and the second cavity so that when the projectable element projects, well fluid is drawn into the second cavity 31, and when the projectable element is retracted again, the second cavity 31 ejects the well fluid out again.

As shown in FIG. 4B, the chamber 28 has a longitudinal extension $L_{10}$ which extends along the longitudinal extension of the tool. By having a chamber with a longitudinal extension, the tool may have room for at least two springs 14 arranged in the chamber 28 matching the longitudinal extension of the chamber, as shown in FIG. 5. The second bore part 5 has an extension of at least 50% of the tool diameter, and in FIG. 5, the second bore part 5 has an extension of at least 75% of the tool diameter.

In FIG. 1, part of the fluid channel 16 extends parallelly to the longitudinal extension of the tool past the projectable element 6. In other parts of the tool, the fluid channel 16 extends in the centre of the tool.

Figure 6:
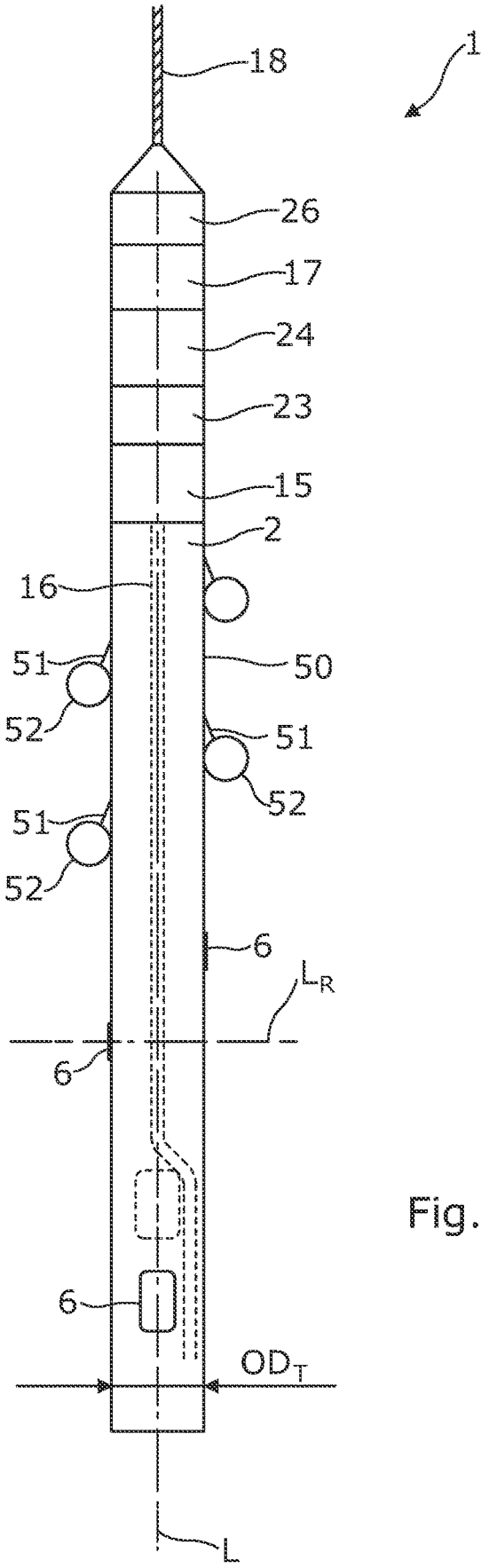
FIG. 6 shows a tool string having another downhole tool having several projectable elements and a driving unit.

FIG. 6 shows a downhole tool string comprising the downhole tool described above and a driving unit 50 for propelling the tool string forward in the well. Even though it is not shown, the tool string may comprise a stroking tool, which is a tool providing an axial force. The stroking tool comprises an electrical motor for driving a pump. The pump pumps fluid into a piston housing to move a piston acting therein. The piston is arranged on the stroker shaft. The pump may pump fluid into the piston housing on one side and simultaneously suck fluid out on the other side of the piston.

By fluid or well fluid is meant any kind of fluid that may be present in oil or gas wells downhole, such as natural gas, oil, oil mud, crude oil, water, etc. By gas is meant any kind of gas composition present in a well, completion or open hole, and by oil is meant any kind of oil composition, such as crude oil, an oil-containing fluid, etc. Gas, oil and water fluids may thus all comprise other elements or substances than gas, oil and/or water, respectively.

By a casing or well tubular metal structure is meant any kind of pipe, tubing, tubular, liner, string, etc. used downhole in relation to oil or natural gas production.

In the event that the tool is not submergible all the way into the casing, a driving unit 50 such as a downhole tractor can be used to push the tool all the way into position in the well, as shown in FIG. 6. The downhole tractor may have projectable arms 51 having wheels 52, wherein the wheels contact the inner surface of the casing for propelling the tractor and the tool forward in the casing. A downhole tractor is any kind of driving tool capable of pushing or pulling tools in a well downhole, such as a Well Tractor®.

Although the invention has been described in the above in connection with preferred embodiments of the invention, it will be evident for a person skilled in the art that several modifications are conceivable without departing from the invention as defined by the following claims.

The invention claimed is:

1. A downhole tool for projecting a projectable element downhole in order for the tool to perform an operation in a well, comprising:

a tool body having a tool outer diameter and a longitudinal extension, a radial bore extending in a radial direction perpendicular to the longitudinal extension, the radial bore having a first bore part having a first inner diameter and a second bore part having a second inner diameter being larger than the first inner diameter, a projectable element arranged and forming a piston in the radial bore, the projectable element having an open first end and a closed second end, the projectable element having a retracted position and a projected position where the second end is projected from the first bore part, the projectable element comprising at the second end a first element part having a first outer diameter corresponding to the first inner diameter and a second element part having a second outer diameter corresponding to the second inner diameter, in the retracted position the projectable element and the second bore part define an annular cavity closed by the second element part, a hollow base part having an open end and a closed end, the open end extending into the open first end of the projectable element forming a chamber therebetween, the open end of the hollow base part having an outer diameter which corresponds to an inner diameter of the projectable element, at least one spring element arranged in the chamber and connected to the closed first end of the projectable element and to the closed end of the hollow base part for retraction of the projectable element, a pump configured to pump fluid into the chamber via a fluid channel to move the projectable element into the projected position, wherein the annular cavity is filled with fluid which leaves the annular cavity as the projectable element changes to the projected position minimising the annular cavity.

2. A downhole tool according to claim 1, wherein the annular cavity has a first cavity extension in the longitudinal extension being at least 20% of the tool diameter.

3. A downhole tool according to claim 2, wherein the annular cavity has a second cavity extension perpendicular to the longitudinal extension which is less than the first cavity extension.

4. A downhole tool according to claim 1, further comprising a first sealing element configured to seal between the first element part and the first bore part, and the second element part comprising a second sealing element configured to seal between the second element part and the second bore part and thereby sealing off the annular cavity.

5. A downhole tool according to claim 1, wherein the first bore part is provided by a first annular flange in the tool body, and the second element part is shaped as a second annular flange, and the annular cavity is defined between the first annular flange and the second annular flange.

6. A downhole tool according to claim 1, wherein the chamber is fluidly connected to the annular cavity via the pump or a hydraulic section.

7. A downhole tool according to claim 1, wherein the second element part projects from the first element part perpendicular to the radial direction forming a projected area, and fluid in the chamber presses on a chamber area of an internal face of the first element part of the projectable element in order to project the projectable element, the projected area and the chamber area are substantially of the same size.

8. A downhole tool according to claim 1, wherein the tool comprises several projectable elements arranged so a first projectable element projects in a first direction, and an adjacent second projectable element projects in a second direction opposite of the first direction.

9. A downhole tool according to claim 8, further comprising a third projectable element projecting in a third direction perpendicular to the first direction, and an adjacent fourth projectable element projecting in a fourth direction opposite of the third direction.

10. A downhole tool according to claim 1, wherein part of the fluid channel extends partly into the closed end of the hollow base part for guiding fluid into the chamber.

11. A downhole tool according to claim 1, wherein the second element part divides the second bore part into the annular cavity and a second cavity, which is in fluid communication with an opening in the tool for providing fluid communication between the well and the second cavity.

12. A downhole tool according to claim 1, wherein the chamber has a longitudinal extension along the longitudinal extension of the tool.

13. A downhole tool according to claim 12, wherein the tool may have at least two springs arranged in the chamber matching the longitudinal extension of the chamber.

14. A downhole tool according to claim 1, wherein the second bore has an extension of at least 50% of the tool diameter.

15. A downhole tool string comprising the downhole tool according to claim 1 and a driving unit for propelling the tool string forward in the well.

* * * * *